US006131838A

United States Patent [19]

Balvanz et al.

[11] Patent Number: 6,131,838

[45] Date of Patent: Oct. 17, 2000

[54] SADDLE-BACK HAMMER TIP

[75] Inventors: Loran Balvanz; Paul Gray, both of New Providence, Iowa

[73] Assignee: U.S. Manufacturing Inc., New Providence, Iowa

[21] Appl. No.: 09/326,209

[22] Filed: Jun. 4, 1999

[51] Int. Cl.[7] ..... B02C 13/02

[52] U.S. Cl. ..... 241/195; 241/197; 241/300

[58] Field of Search ..... 241/189.1, 197, 241/300, 291, 195

[56] References Cited

U.S. PATENT DOCUMENTS

| | | | |
|---|---|---|---|
| Re. 24,806 | 4/1960 | Christiansen . | |
| D. 360,421 | 7/1995 | Schulz et al. | D15/126 |
| 1,761,083 | 6/1930 | Liggett . | |
| 1,997,553 | 4/1935 | Taylor, Jr. et al. | 241/197 |
| 2,467,865 | 4/1949 | Smith | 241/197 |
| 2,986,347 | 5/1961 | Stevenson . | |
| 2,994,486 | 8/1961 | Trudeau | 241/197 |
| 3,096,035 | 7/1963 | Allen et al. . | |
| 3,642,214 | 2/1972 | Blackwell, Jr. | 241/191 |
| 3,680,797 | 8/1972 | Covey . | |
| 3,929,296 | 12/1975 | Stoeber . | |
| 4,136,833 | 1/1979 | Knight . | |
| 4,161,294 | 7/1979 | Lautenschlager et al. . | |
| 4,162,770 | 7/1979 | Lewis . | |
| 4,915,309 | 4/1990 | Schmidt . | |
| 5,022,593 | 6/1991 | Stelk . | |
| 5,285,974 | 2/1994 | Cesarini . | |
| 5,307,719 | 5/1994 | MacLennan . | |
| 5,320,292 | 6/1994 | Smith . | |
| 5,377,919 | 1/1995 | Rogers et al. | 241/189.2 |
| 5,720,440 | 2/1998 | Bonner et al. . | |
| 5,967,436 | 10/1999 | Balvanz | 241/291 |

*Primary Examiner*—John M. Husar
*Attorney, Agent, or Firm*—Daniel A. Rosenburg; Kent A. Herink; Davis Law Firm

[57] ABSTRACT

A hammer tip is provided with a centrally located bolt hole for receipt of at least one bolt for releasable securement to a hammer. The hammer tip includes a front face having a working edge, and a back with two opposing shoulder sections with a recessed section therebetween. The hammer includes a support shoulder for receipt of the bottom of the hammer tip. Together, the shoulder sections, the recess formed between, and the support shoulder create a saddle-back for releasable integration with the hammer.

8 Claims, 6 Drawing Sheets

SADDLE-BACK HAMMER TIP

BACKGROUND OF THE INVENTION

1. Field of Invention

The present invention relates to a hammer tip for releasable integration with a hammer, and in particular, to a hammer tip having a milled back portion with two opposing shoulder-sections with a recessed section therebetween forming a saddle-back for releasable integration with the hammer.

2. Background

In the art of construction of size reducing machines like rotary hammermills, tub grinders, vertical and horizontal feed machines, and the like, one of the most persistent problems faced by designers and operators of such equipment comprises securing the hammer tips to the hammers. In the prior art, the conventional method for attaching a hammer tip to a hammer comprises inserting one or two threaded bolts through a bolt hole in the hammer tip and hammer then securing the bolt with a threaded nut. Generally, this comprises the sole means of attachment. During operation of the size reducing machine, however, the hammer tips come into frequent and violent contact with the product being size reduced and foreign objects. This places stress of all types from all directions on the hammer tip. Frequently, the striking force inflicted on the hammer tip begins to laterally torque, rotate, or twist the hammer tip, which eventually begins to peen the bolt holes. The twisting or rotational force on the hammer tip begins to force the bolts and bolt heads against the bolt hole introducing play. The additional play allows the bolt to move which will loosen the nut, or otherwise introduce movement between the hammer tip and the hammer. Once loosened, the play introduced will cause the bolt to break, or otherwise come loose throwing the hammer tip into the machine.

This can result in substantial damage not only to the hammer tip and hammer, but in some cases, also to the machine. Also, in many cases, a hammer tip is thrown well before the hammer tip is worn to the point of needing replacement.

While it is possible to design hammer tips and hammers that permanently attach, this proves an undesirable solution to the problem. The frequent striking force applied to the hammer tip creates substantial wear, which means these parts require relatively frequent replacement. The hammers, on the other hand, while undergoing some wear, do not require replacement at or near the same frequency as hammer tips. Permanently securing the hammer tips to the hammers would require placement of both. This would require premature replacement of the hammers. Also it requires substantially more time and effort to replace the hammers, when compared to simply replacing a hammer tip.

Accordingly, a need exists in the art for better integrating hammer tips and hammers in a releasably securable manner.

SUMMARY OF THE INVENTION

An object of the present invention comprises providing a saddle-back hammer tip for releasable engagement with a hammer that substantially reduces the chance of the hammer tip prematurely separating from the hammer.

These and other objects of the present invention will become apparent to those skilled in the art upon reference to the following specification, drawings, and claims.

The present invention intends to overcome the difficulties encountered heretofore. To that end, a hammer tip is provided with a centrally located bolt hole for receipt of at least one bolt for releasable securement to a hammer. The hammer tip includes a front face having a working edge, and a back with two opposing shoulder sections with a recessed section therebetween. The shoulder sections and the recess formed between create a saddle-back for releasable integration with the hammer.

DETAILED DESCRIPTION OF THE INVENTION

Figure 1A:
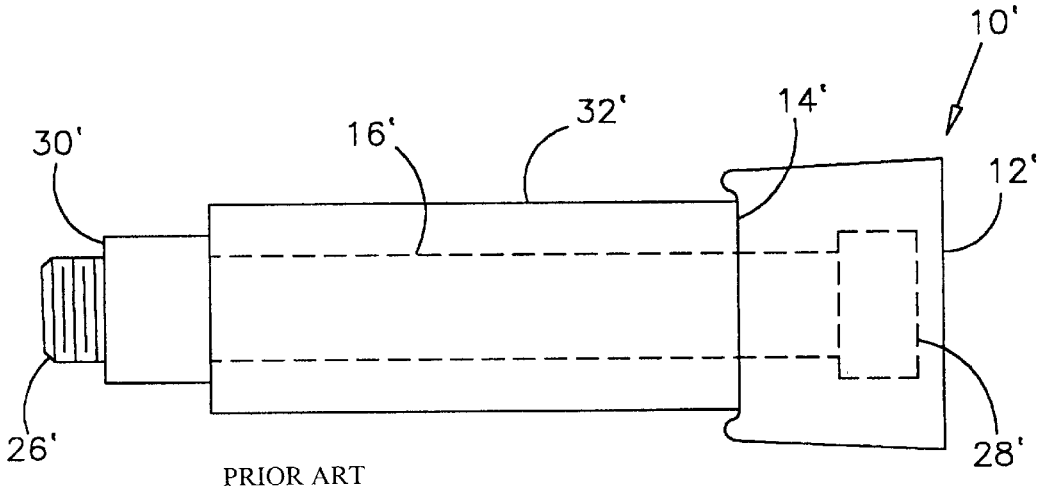
FIG. 1*a* shows a top plan view of a prior art hammer and a bolted on hammer tip.
Figure 2B:
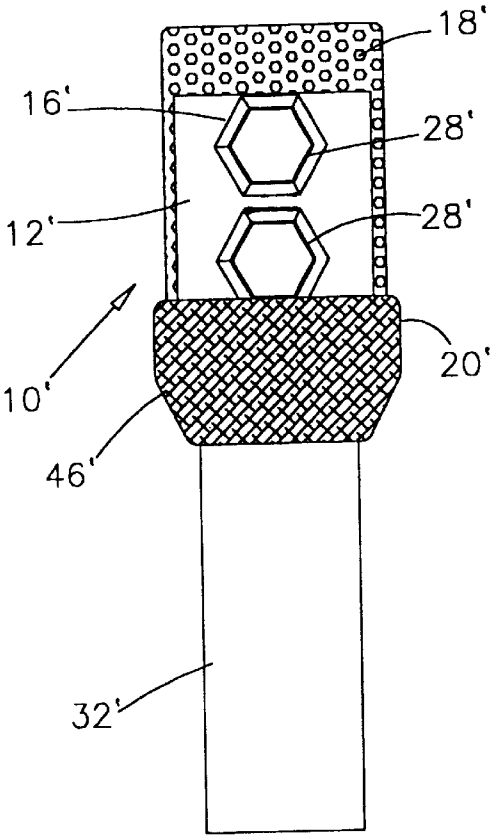
PRIOR ART FIG. 2b
FIG. 2*b* shows a front elevational view of the prior art hammer and hammer tip of FIG. 1*a*.
Figure 2A:
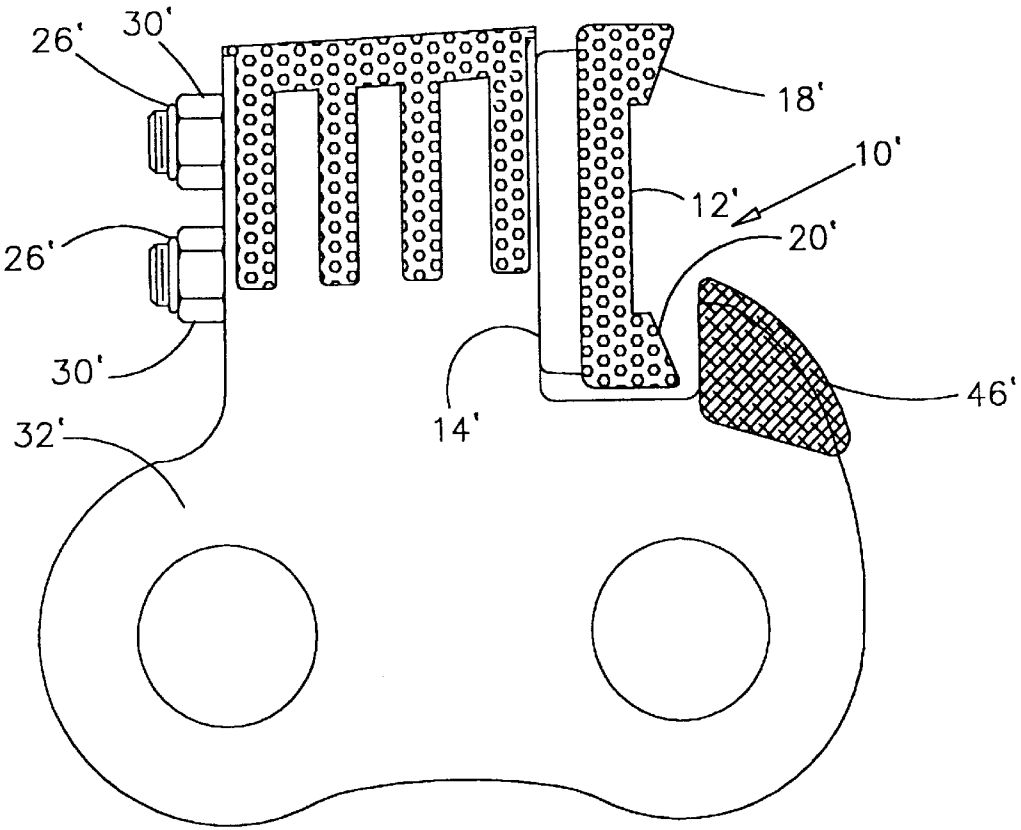
PRIOR ART FIG. 2a
FIG. 2*a* shows a side elevational view of the prior art hammer and hammer tip of FIG. 1*a*.

In the figures, FIG. 1*a* shows a prior art hammer tip 10' releasably secured to a hammer 32'. The conventional hammer tip 10' comprises a front face 12' and a back 14'. The front face 12' faces the debris and absorbs the impact during operation, while the back 14' of the hammer tip 10' comes into physical contact with the hammer 32' upon securement thereto. A threaded bolt(s) 26', passing through bolt hole(s) 16' in the hammer tip 10' and the hammer 32', secure the hammer tip 10' to the hammer 32' through attachment of nut(s) 30'. FIG. 2*b* shows in further detail that the prior art hammer tip 10' on its front face 12' includes one or two bolt holes 16' for receipt of the bolt heads 28' of the bolts 26'. Traditionally, hexagonal design of the bolt heads 28' and in part the bolt holes 26' provide for some support to resist movement of the bolt heads 28' within the bolt holes 16' of the hammer tip 10'. While some prior art hammer tips 10' include a small overlapping lip on either side of the back 14', it proves insufficient to resist the rotation and twisting induced by the striking force that occurs during operation. Additionally, the prior art hammer tip 10' and hammer 32' do not provide any support against downward impact. Accordingly, conventional hammer tips offer little or no attachment or securement support other than one or two threaded bolts and nuts.

Figure 1B:
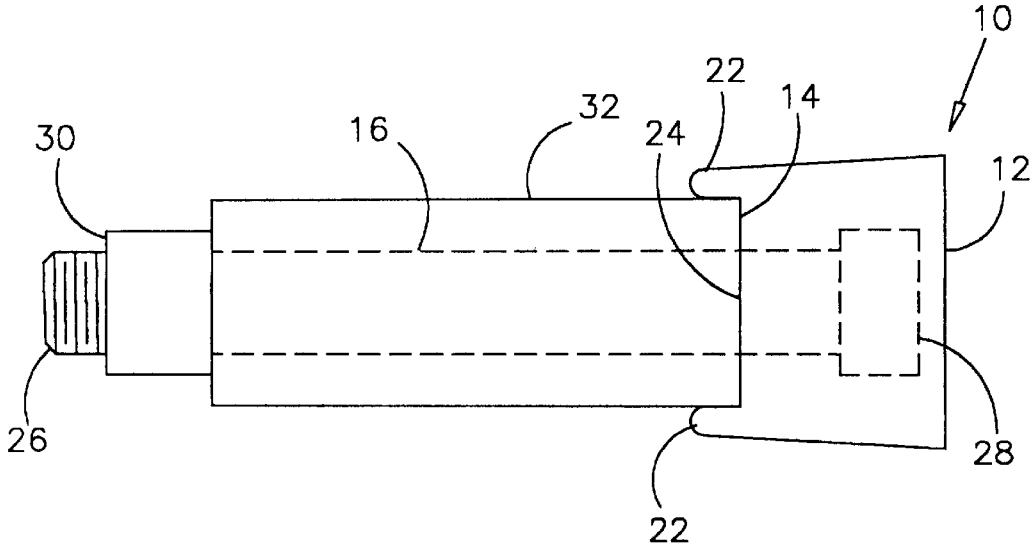
FIG. 1*b* shows a top plan view of a hammer and a bolted on hammer tip of the present invention.
Figure 3B:
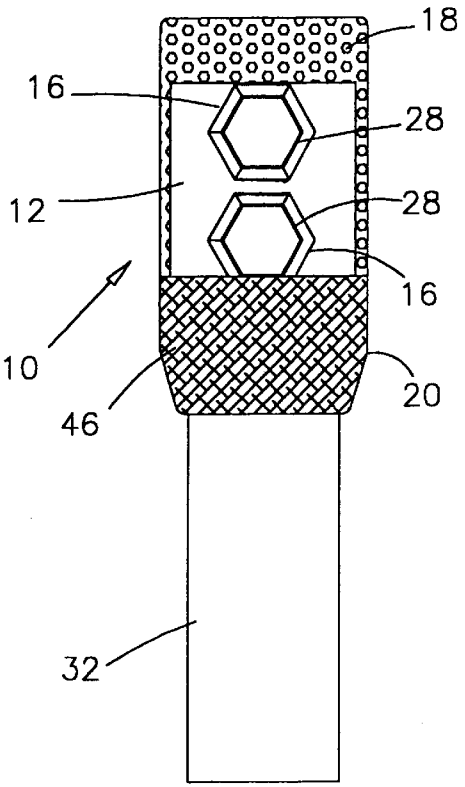
FIG. 3*b* shows a front elevational view of the hammer and hammer tip of FIG. 1*b*.
Figure 3A:
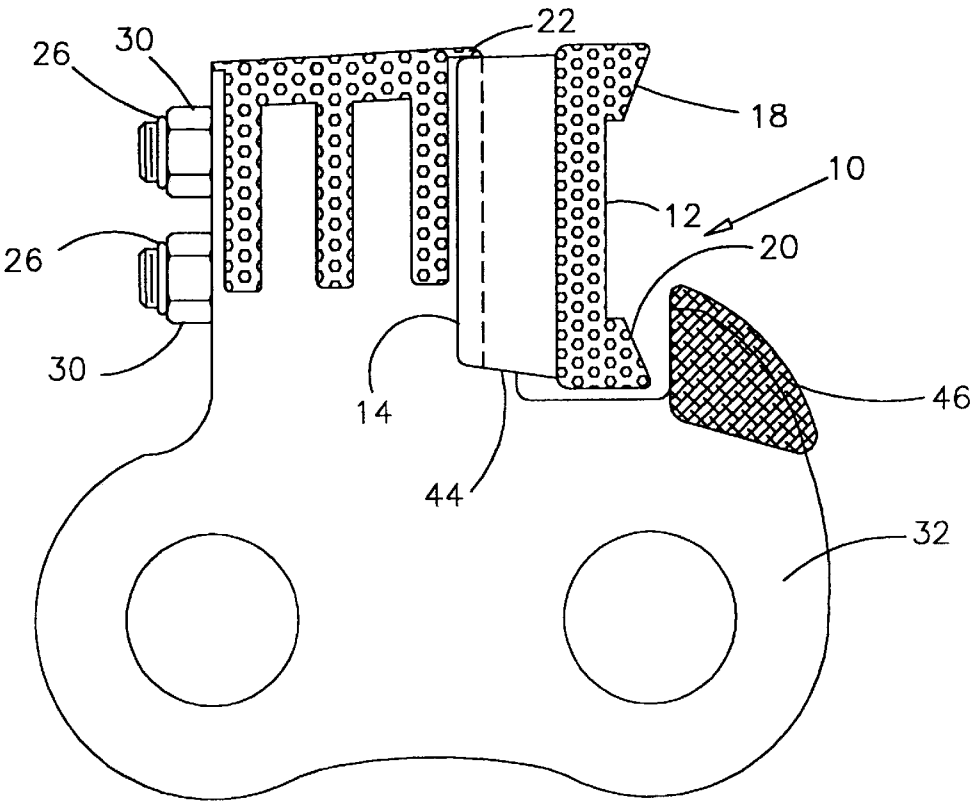
FIG. 3*a* shows a side elevational view of the hammer and hammer tip of FIG. 1*b*.

According to the present invention, FIG. 1*b* shows a hammer tip 10 secured to a hammer 32 through a threaded bolt 26 inserted through a bolt hole 16 in the hammer tip 10 and the hammer 32. A threaded nut 30 affixes to the bolt 26 to complete securement. Shown best in FIG. 3*a* and *b*, the hammer tip 10 includes a front face 12 with one or more bolt holes 16 for receipt of the bolt heads 28 of the bolts 26.

Again, like the conventional design, the bolt holes 16 initially presents a hexagonal shape for receipt of the corresponding hexagonal shaped bolt head 28. This prevents or reduces the opportunity for the bolt head 28 to move or rotate independent of the hammer tip 10. The front face 12 of the hammer tip 10 also comprises a working edge 18, and a protected edge 20. The working edge 18 of the hammer tip 10, is designed as the primary impact surface during operation. Alternatively, rotation of the hammer tip 10 allows for swapping the working edge 18 and the protected edge 20. A production pocket 46 protects the edge 20 from impact with debris during operation, and forces debris toward the working edge 18. The production pocket 46 is described in greater detail in U.S. patent application No. 09/092,198 now U.S. Pat. No. 5,967,436 incorporated herein by reference. The hammer tip 10 of the present invention is designed for seamless integration with the invention as disclosed in the aforementioned patent application.

Figure 4:
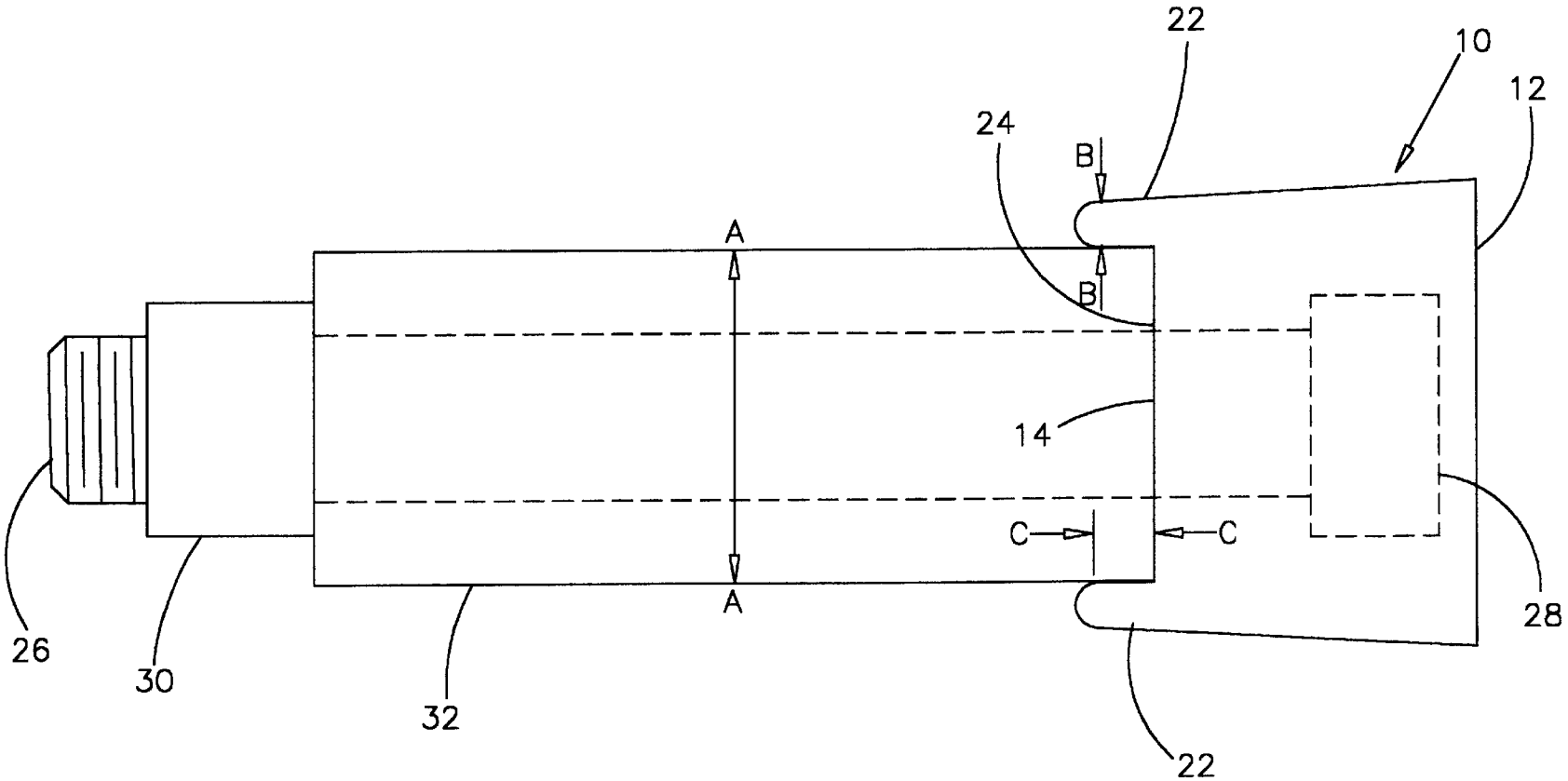
FIG. 4 shows a top plan view of the hammer and hammer tip of FIG. 1*b*.

The hammer tip 10 includes two opposing shoulder-sections 22 with a recessed section 24 therebetween (see FIG. 4). The recess 24 between the opposing shoulder-sections 22 forms a saddle-back for releasable integration with the hammer 32. In other words, the shoulder-sections 22 form ridges on either side of the hammer 32 running the entire vertical length of the outsides of the back 14 of the hammer tip 10. The shoulder-sections 22 along with the recess 24 and a shoulder seat 44 form a pocket or saddle whereby the hammer tip 10 engages the forward edge of the upper portion of the hammer 32. The shoulder seat 44 provides important support to the hammer tip 12 from rotating or moving in the face of downward impact force, that otherwise would introduce play between the bolts 26, bolt head 28, and bolt hole 16. This saddle forms to, or grips, the hammer 32 to resist the kind of impact force, lateral torque, rotation, or twisting that can cause the hammer tip 10 to loosen and cause sheering of the bolts 26 commonly experienced by prior art designs. The fit between the hammer tip 10 and the hammer 32 is further enhanced by precision milling of the back 14 of the hammer tip 10. This removes any residual play between the hammer tip 10 and the hammer 32 that can translate to the bolts 26, bolt heads 28, and bolt holes 16.

Experimentation shows a specific dimensional design best prevents the type of rotating and twisting motion that can throw a hammer tip 10. In particular, if the hammer width is defined as the distance on either side of the arrows marked AA in FIG. 4, the width of the shoulder-sections 22 should be at least 12% of the hammer width. In other words, the distance between arrows BB in FIG. 4 should equal at least 12% of the hammer width. Further, the recessed section 24 lying between the opposing shoulder-sections 22 along the back 14 of the hammer tip 10, should have a depth of at least 12% of the hammer width. The depth of the recessed 24 is shown in FIG. 4 as the distance between the arrows CC. Another dimension of importance, comprises the relationship between the distance between the shoulder-sections 22 and the hammer 32, when compared to the distance between the bolt head 28 and the bolt hole 16. The opposing shoulder-sections 22 of the hammer tip 10 should fit with sufficient snugness over the hammer 32 that the gap between the hammer and the opposing shoulder-sections 22 is less than the gap between the bolt hole 16 and the bolt head 28. This will ensure that whatever minimal play that exists between the hammer tip 10 and the hammer 32 is insufficient to allow the bolt head 28 to contact or impinge on the bolt hole 16. This will prevent the striking force from peening the bolt hole 16 or from loosening the nut 30 that can result in sheering of the bolt 16. The entirety of the rotational or twisting force experienced by the hammer tip 10 is absorbed by the opposing shoulder-sections 22 and the recess 14 lying therebetween.

Following the aforementioned dimensioning guidelines will provide for a recess 14 and opposing shoulder-sections 22 of sufficient strength to fully integrate the hammer tip 10 with the hammer body 32 in a manner that will prevent the undesired detachment experienced in the prior art. The hammer tip 10 is precision milled and machined to match the adjoining surfaces of the hammer 32 to provide for virtually seamless integration. The precision of the fit between the hammer tip 10 and hammer 32 allows them to function like one unit, while maintaining the advantages of associated with separate units. In order to provide for the precise dimensioning required to achieve the desired results, the hammer tip 10 is both forged and precision machined according to the following specifications in the preferred embodiment.

FIGS. 5*a–d* show an embodiment of the hammer tip 50 comprising two bolt holes 56 for the insertion of two bolts 26. FIGS. 6*a–c* show an embodiment of the hammer tip 70 comprising one bolt hole 76 for the insertion of one bolt 26. Those of ordinary skill in the art will appreciate the fact the following description of the size and shape of the hammer tip can vary with departing from the scope of the invention.

Figure 5A:
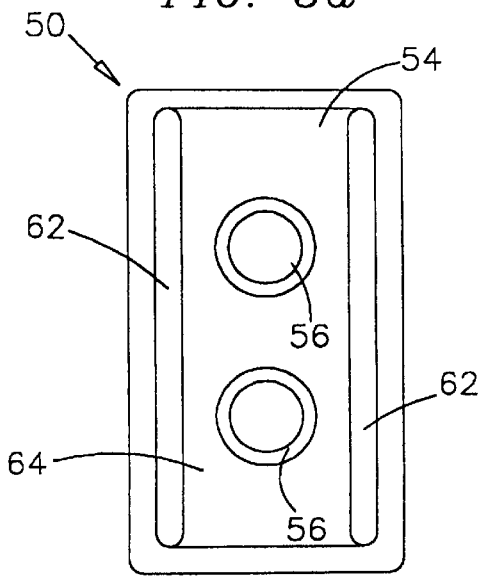
FIG. 5*a* shows a bottom view of a dual bolt hammer tip.
Figure 5B:
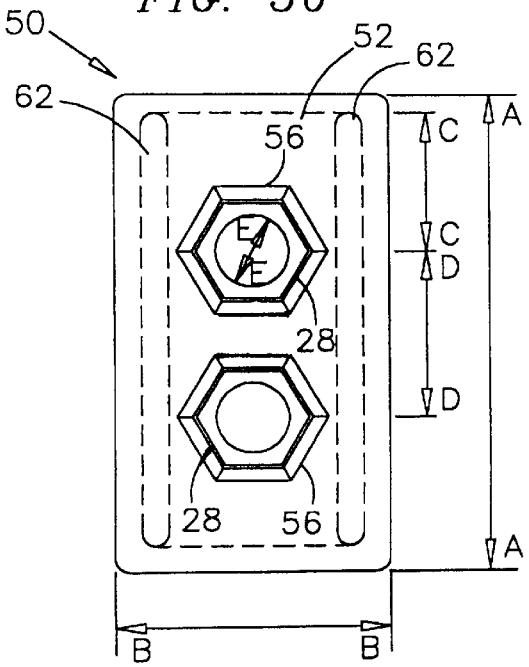
FIG. 5*b* shows a top view of the dual bolt hammer tip.
Figure 5C:
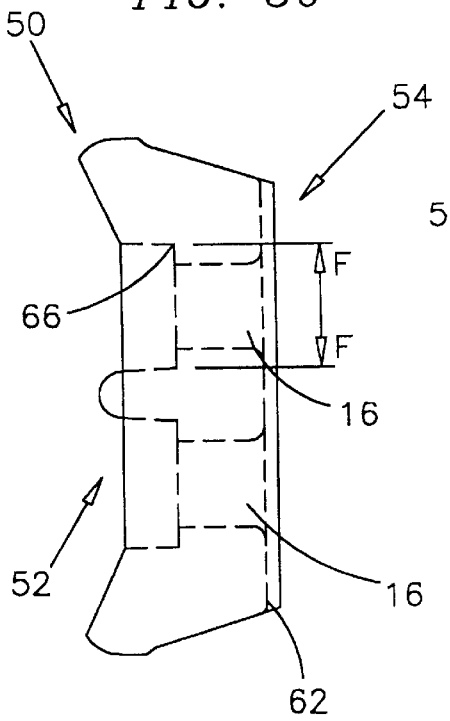
FIG. 5*c* shows a side view of the dual bolt hammer tip.
Figure 5D:
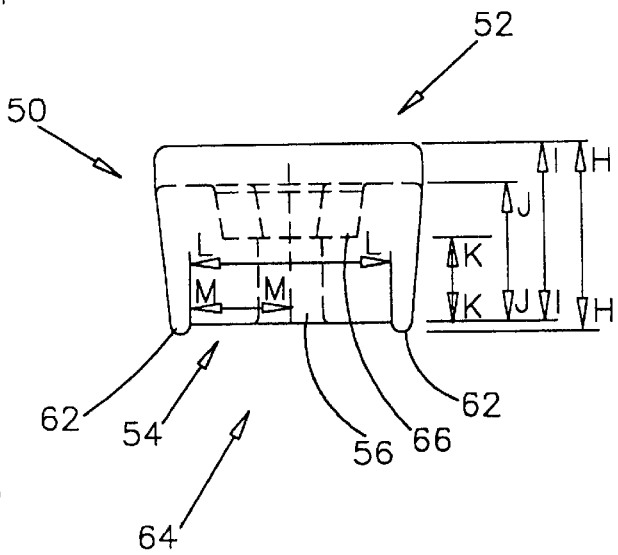
FIG. 5*d* shows an end view of the dual bolt hammer tip.
Figure 6C:
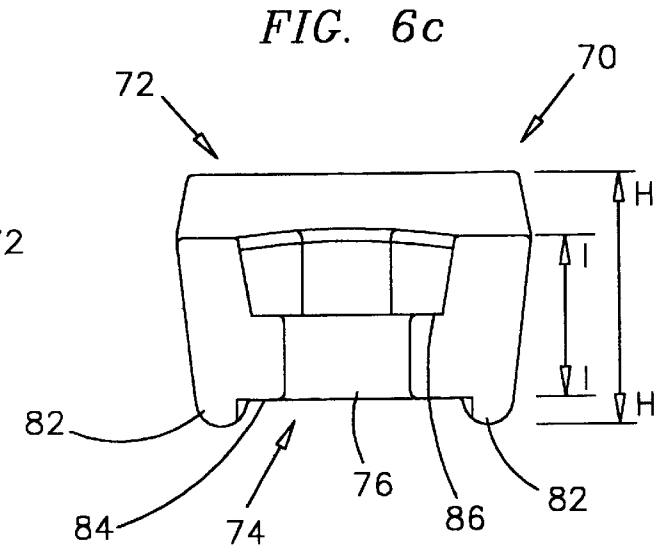
FIG. 6*c* shows an end view of the single bolt hammer tip.
Figure 6B:
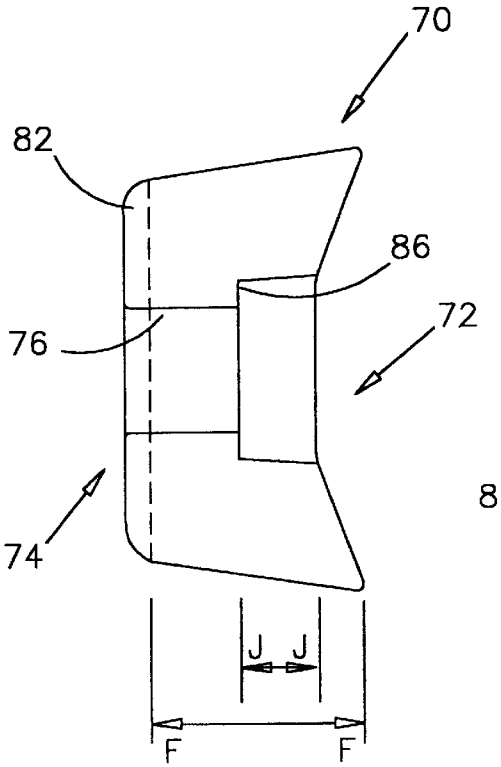
FIG. 6*b* shows a side view of the single bolt hammer tip.
Figure 6A:
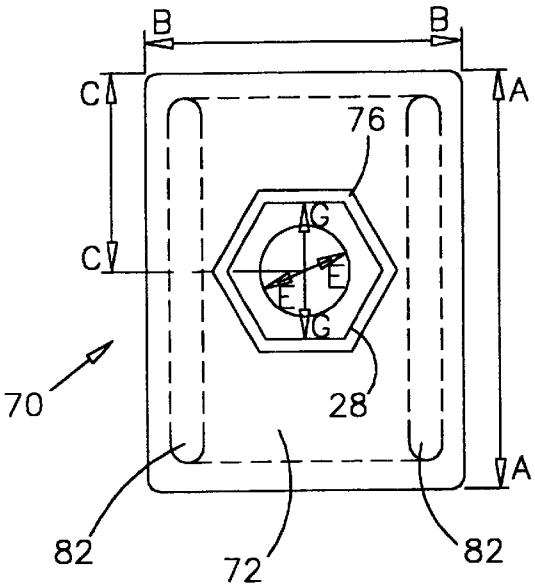
FIG. 6*a* shows a top view of a single bolt hammer tip.

FIG. 5*a* shows the back 54 of the hammer tip 50, including the opposing shoulder sections 62 along with a recess 64 defined therebetween. All of these surfaces are precision machined to achieve the desired fit to the hammer 32. The hammer tip 50 measures 4.75" along the line AA, and 2.75" along the line BB as shown in FIG. 5*b*. FIG. 5*d* shows that the hammer tip 50 measures 1.93" along the line HH. The hammer tip So measures 1.75" along the line II, which measures the distance from the recess 64 to the top of the working edge 58. This means the recess 64 is displaced a total of 0.18" from the tip of the shoulder sections 62. The line JJ measures the distance from the surface of the hammer tip 50 (ignoring the working edge 58) to the recess 64 at 1.375". The bolt holes 56 are centered such that the distance along the line CC measures 1.531", and the distance between the bolt hole 56 centers measures 0.687"±0.01" (generally measurement tolerances are ±0.03" except as noted otherwise). The cylindrical portion of the bolt holes 56, as shown along the line EE, measures 0.781"±0.01" in diameter. The portion of the bolt holes 56 designed for receipt of the bolt head 28 measures 1.14" as shown along the line FF in FIG. 5*c*, and is recessed 0.6" as shown by the line KK in FIG. 5*d*. The difference in length between lines EE and FF creates a bolt socket shoulder 66 for the bolt head 28 to set against. Thus, the hexagonal shape of the upper portion of the bolt holes 56, and the corresponding hexagonal shape of the bolt head 28 allow the bolts 26 to set squarely on the socket shoulder 66. The maximum radius of the socket shoulder 66 equals 0.030", this will ensure that the socket shoulder 66 can snugly receive the bolt head 28. This prevents rotation of the bolts 26 relative to the hammer tip 50. The distance along the line LL measures 2.040"+0.010"−0.005", and represents the distance between the inner edges of the shoulder sections 62. The distance along the line MM measures 1.020"±0.005", and represents the distance from the center of the bolt hole 56 to the inside edge of the shoulder section 62. The dimensions shown in lines LL and MM show that the recess 64 is centered relative to the bolt hole 56.

The hammer tip 70 shown in FIGS. 6*a–c* is otherwise identical to the hammer tip 50, except for the dimensional differences associated with the inclusion of only one bolt hole 76 in the hammer tip 70. The hammer tip 70 measures 3.476" along the line AA, and 2.836" along the line BB. The hammer tip 70 measures 1.967" along the line HH shown in FIG. 6*c,* and 1.667" along the line FF shown in FIG. 6*b*. The difference between the lines HH and FF represent the depth of the recess 84 created by the shoulder sections 62. The line II, measuring 1.28" in length, depicts the width of the hammer tip 70 when subtracting for the working edge 58. The distance of line CC of 1.613", locates the center of the bolt hole 76 relative to the top of the front face 52 of the hammer tip 70. The cylindrical portion of the bolt hole 76 measures 0.890"±0.10" in diameter as shown along the line EE, while the hexagonal portion of the bolt hole 76 measures 1.345"+0.000"−0.030" between the points GG. Again, the dimension of the bolt hole 76 is designed to prevent rotation of the bolt 26 relative to the hammer tip 70. The line JJ, measuring 0.552" shows the depth of the recess of the hexagonal portion of the bolt hole 76. Again, in a manner similar to that described for hammer 50, this creates a socket shoulder 86 for the bolt head 28 to set against and is designed to prevent rotation of the bolt 26 relative to the hammer tip 70.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

We claim:

1. A hammer tip for releasable integration with a hammer, said hammer tip comprising:

a) a centrally located bolt hole for receipt of a bolt to releasably secure said hammer tip to the hammer;

b) a front face having a distally located working edge; and c) a back having two opposing shoulder sections with a recessed section therebetween forming a saddle-back means for releasable integration with said hammer, thereby resisting impact force, lateral torque, rotation, or twisting of the type that can cause said hammer tip to loosen and can cause sheering of said bolt.

2. The invention in accordance with claim 1 wherein said shoulders of said back of said hammer tip have a width of at least 12% of the width of the hammer.

3. The invention in accordance with claim 1 wherein said recessed section between said shoulder sections of said back of said hammer tip have a depth of at least 12% of the width of the hammer.

4. The invention in accordance with claim 1 wherein said bolt hole is recessed to receive a head of said bolt.

5. The invention in accordance with claim 4 wherein said distance between said shoulder sections of said back of said hammer tip and said hammer is less than the distance between said bolt hole of said hammer tip and said bolt head.

6. The invention in accordance with claim 1 further comprises two centrally located bolt holes.

7. The invention in accordance with claim 1 wherein the hammer comprises a shoulder seat for support of a bottom of said hammer tip.

8. The invention in accordance with claim 1 wherein said back of said hammer tip is precision milled to fit the hammer.

* * * * *